United States Patent [19]

Wagner

[11] 3,996,016

[45] Dec. 7, 1976

[54] VARIABLE CAPACITY CATALYTIC CONVERTER

[75] Inventor: Melvin H. Wagner, Bartlett, Ill.

[73] Assignee: UOP Inc., Des Plaines, Ill.

[22] Filed: Dec. 29, 1975

[21] Appl. No.: 645,120

[52] U.S. Cl. ..... 23/288 F

[51] Int. Cl.[2] ..... F01N 3/15

[58] Field of Search ..... 23/288 F, 288 FB, 288 FC; 60/299

[56] References Cited

UNITED STATES PATENTS

| | | | |
|---|---|---|---|
| 2,674,521 | 4/1954 | Houdry | 23/288 FC |
| 3,166,895 | 1/1965 | Slayter et al. | 23/288 FC X |
| 3,492,098 | 1/1970 | DePalma et al. | 23/288 FB |
| 3,771,959 | 11/1973 | Fletcher et al. | 23/288 F X |
| 3,811,845 | 5/1974 | Nakamura | 23/288 FC |
| 3,879,944 | 4/1975 | Bertsch | 23/288 FB X |

FOREIGN PATENTS OR APPLICATIONS

| | | | |
|---|---|---|---|
| 588,160 | 12/1959 | Canada | 23/288 FB |
| 631,368 | 6/1936 | Germany | 23/288 F |

*Primary Examiner*—Joseph Scovronek
*Attorney, Agent, or Firm*—James R. Hoatson, Jr.; Barry L. Clark; William H. Page, II

[57] ABSTRACT

A variable capacity catalytic converter for control of noxious exhaust emissions from combustion engines consists of a plurality of interchangeable parts or modules each having a male portion and a female portion, which can be assembled in an additive way to provide the capability of producing a range of sizes of catalytic converters having varying volumes of catalyst while utilizing identical sets of components. Depending upon the engine requirements with which the converter is to be used, different numbers of modules can be assembled by stacking. An inward projection on an end cap of each module helps maintain a turbulent flow of gases through the device to produce uniform flow through all of the catalyst beds.

11 Claims, 5 Drawing Figures

VARIABLE CAPACITY CATALYTIC CONVERTER

BACKGROUND OF THE INVENTION

Catalytic converters intended for control of noxious exhaust emissions from combustion engines are generally of unitary construction, consisting of a catalyst bed sized to hold a specific volume of catalyst and a housing which defines a chamber for directing the exhaust gases through the catalyst bed. The housing includes inlet and outlet extensions which permit the unit to be installed in an exhaust system. The permanency of the aforementioned type of construction wherein the parts are usually assembled by welding precludes any means of disassembly other than to cut through the welded junctures, which, in most cases, is impractical to do. Thus, to inspect, refill, repair or replace the inner components of a converter would not be a practical consideration.

Another restrictive feature of a unitary construction can be seen in the lack of interchangeability of components. For example, the catalyst bed and housing components are generally fabricated to dimensions which provide for a specific catalyst volume. If a different catalyst volume is desired, it is generally necessary to fabricate a different set of components having dimensions which relate to that desired catalyst volume. Although many patents such as U.S. Pat. Nos. 3,186,806; 3,544,264; 3,773,894; 3,775,064; and 3,793,830, for example, show catalytic converters comprising a series of spaced beds, the exhaust gas flow in these arrangements must move serially through all of the catalyst beds with a resulting increase in back pressure. The aforementioned patents dislcose devices in which the capacity is predetermined in that the housings are designed for a certain number of catalyst beds. U.S. Pat. No. 3,687,637 and Canadian Pat. No. 588,160 each show catalytic converters in which a number of catalyst-containing modules may apparently be stacked together. However, like the aforementioned prior art patents, the exhaust gases must flow serially through all of the catalyst chambers and are thus subjected to ever increasing back pressure as the number of modules increases.

SUMMARY OF THE INVENTION

It is among the objects of the present invention to provide a catalytic converter which is formed of a limited number of components but which can be assembled into a unit made up of any desired number of sections or modules depending upon the volume of catalyst required for a particular application. It is a further object of the invention to provide a catalytic converter which can be assembled to include varying numbers of catalyst bed sections without significantly increasing the back pressure through the total device and so that the gases flow relatively uniformly through all of the catalyst sections while passing through each catalyst section only once.

The aforementioned and other objects are obtained by the embodiments of the present invention wherein a series of modular catalyst bed components can be stacked together to form a unit having any desired catalyst capacity when combined with cooperating inlet and outlet fittings.

In each of two disclosed embodiments the exhaust gases enter the converter through a tubular center inlet member which is attached to an inlet end plate. Each of the axially aligned, radial flow, catalyst bed modules which are positioned inside the converter is telescopically assembled to the adjacent module and is adapted to receive exhaust gases on its inner surface and exhaust said gases from its outer surface into an annular space between the outer wall of the catalyst bed module and the inner wall of the unit's outer housing. In one embodiment, the outer tubular housing portion of the converter which surrounds the stack of catalyst bed modules is spaced from the modules by four right angled channel members, each of which has one or both of its legs tack welded to the outer tubular central housing. The modular catalyst beds, which each comprise a unitary assembly of lower and upper male and female end caps and inner and outer catalyst pellet retaining screens, are axially slidable inside the outer housing into nesting relationship with each other. The modular beds are retained against radial outer movement by the apices of the channel members. A selectively sealed access port in the outer screen of each bed permits catalyst pellets to be added or removed.

The lower end cap of each module includes an annular flange portion which extends radially inwardly relative to the inner screen of the module. The flange portions are important in that they act as turbulators which contact the gases flowing axially through the unit and cause their flow to be turbulent rather than laminar. The turbulence induced by the turbulators results in the amount of gases passing radially outwardly through each catalyst bed to be quite uniform. When turbulators are not used, and the inner module walls are made to be substantially smooth and continuous, the upward flow inside the unit tends to become laminar with the result that the outward flow through the upper catalyst modules adjacent the upper closed end of the inlet chamber is much greater than through the lower ones. Such a condition either overutilizes the catalyst at the top or underutilizes the catalyst at the bottom, with the result that the overall unit must be made larger than necessary to provide a given reduction in noxious pollutants. In my arrangement, the catalyst beds are relatively thin, so that little back pressure is introduced. Thus, the turbulent gases will readily flow through the various beds uniformly.

In a second embodiment, the catalyst bed modules are substantially identical to those in the first embodiment. The principal distinction between the two embodiments resides in the means for stabilizing the position of the catalyst modules to keep them axially aligned and spaced from the outer housing wall. Intermediate bulkhead members having support ring portions integral therewith prevent radial movement of the modules relative to the outer housing. A plurality of elongated slots in each bulkhead permits the passage of gases which have been treated in the catalyst beds to pass to the exhaust chamber. The bulkhead members include planar peripheral edge portions which are adapted to be captured between radially outwardly extending flanges on adjacent pairs of generally tubular outer housing portions. The unit may include one outer housing portion for each catalyst bed module, as shown, or the housing portions may be made of sufficient length to encompass two or more catalyst bed modules. The various housing sections may be held together by clamping rings or by providing a series of peripherally spaced holes for accommodating bolt-like fastener means. The units are preferably cylindrical but could also be of oval or other shape.

DESCRIPTION OF THE PREFERRED EMBODIMENTS

Figure 1:
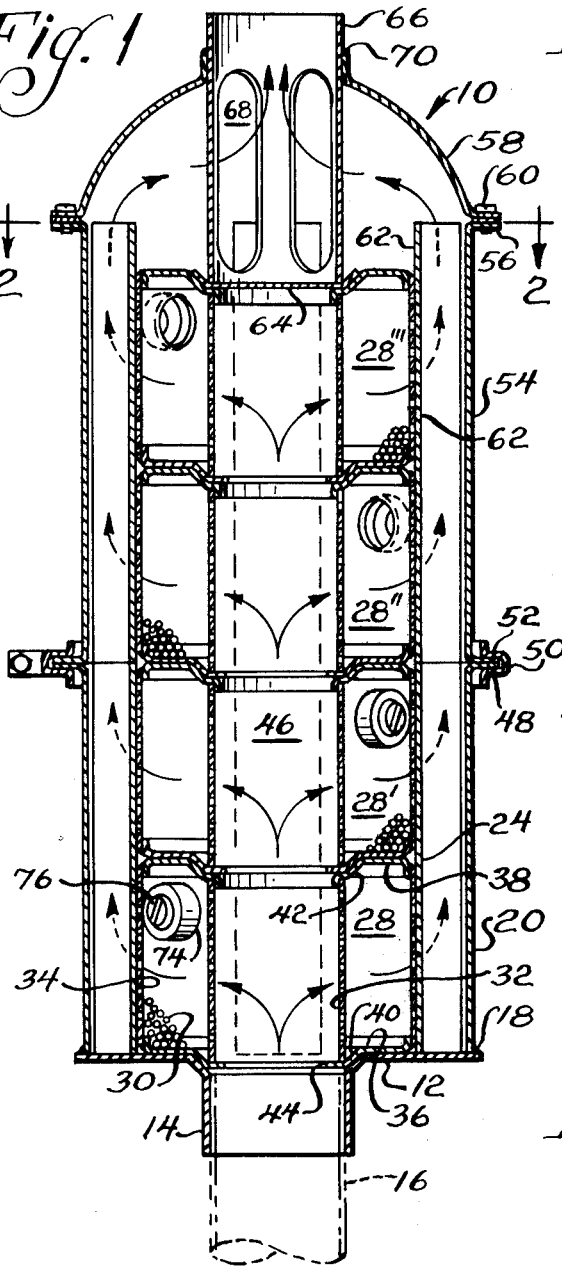
FIG. 1 is an axial cross-section of a preferred embodiment of the invention taken on line 1—1 of FIG. 2.

Referring to FIG. 1, the catalytic converter assembly indicated generally at 10 comprises a lower end plate 12 having a downwardly extending upstream inlet portion 14 which is adapted to interfit with a combustion engine exhaust pipe 16 indicated in dotted lines. Lower end plate 12 is affixed by means of weld bead 18 to a lower outer housing member 20. Positioned inside the lower outer housing member 20 are four right angled channel-like spacer members 24 which have their leg portions retained relative to the housing 20 by a plurality of tack welds 26. Ridge portions 27 on the channels 24 act as guides for the modules during assembly of the modules to the housing and serve to retain the identical catalyst bed modules 28, 28' in the center of the converter.

The catalyst bed modules 28, 28', 28'', 28''', each contain a large number of catalyst coated pellets 30 which function to reduce the pollutants in gases passing through the converter. The modules each comprise an inner perforated screen 32, an outer perforated screen 34, a lower or upstream end cap 36 and an upper or downstream end cap 38. The walls of the module as well as other metallic portions of the converter 10 are preferably made of stainless steel to provide maximum life and resistance to the high temperature and corrosive effect of the exhaust gases. The inner and outer screens 32, 34 are perforated in the usual manner to permit the gases being treated to pass radially outwardly through them. To facilitate the stacking of any desired number of modules to form a converter having a particular catalyst capacity the lower end caps 36 are provided with an angled male portion 40 which engages and nests within complementary upper end cap female portions 42. An inwardly extending turbulator portion 44 is provided for inducing turbulence in the gases passing upwardly through the central inlet chamber 46 of the device so as to insure that the radially outward flow through each module 28—28''' will be uniform.

Where it is desired to make the converter 10 of a capacity greater than about two modules, the lower outer housing portion 20 is provided with an upper flange portion 48 which may be held in place by clamp ring 50 to the lower flange portion 52 of an upper outer housing portion 54. The upper outer housing portion 54 has an upper flange portion 56 which is held to an upper end housing end portion 58 by fastener means such as a clamp ring or a plurality of threaded fasteners 60. Similarly to the lower housing portion 20, the upper housing member 54 has a plurality of channel members 62 tack welded to it for centering the upper modules 28'', 28'''. To insure that gases flowing into the central chamber 46 cannot exit the chamber except by passing radially outwardly through the catalyst bed modules 28-28''', an upper end closure member 64 is provided which bears against the upper module 28'''. The closure member 64 is welded to an exhaust gas outlet tube 66 which contains a plurality of slots 68 through which gases flowing up through the outlet gas chambers 69 defined by the inside walls of the housing portions 20 and 54 and the perforated screens 34 can enter the tube 66 and be exhausted. In order to assure that the loosely stacked modules 28-28''' are retained in place regardless of whether the unit is hot or cold the tube 66 is preferably not welded to the upper housing end portion 58 during initial assembly until it has been forced down against the upper module 28''' so as to apply a preload to the stack of modules. Axial loading of the stack of modules can also be achieved by assembling paper-like washers of a vermiculite gasket material between adjacent end caps 36, 38. The vermiculite gasket material has the property of expanding after it is first heated so as to provide a permanent axial loading on the modules which is greater than the initial loading. The axial loading forces help prevent vibration forces from destroying the catalyst pellets 30.

Although four stacked modules 28–28''' and two outer housing portions 20, 54 have been disclosed in the drawing, the disclosed configuration is merely representative and it is ovbious that the device could incorporate more or fewer modules and different numbers of housing sections, including a single outer tubular housing, if desired.

Figure 2:
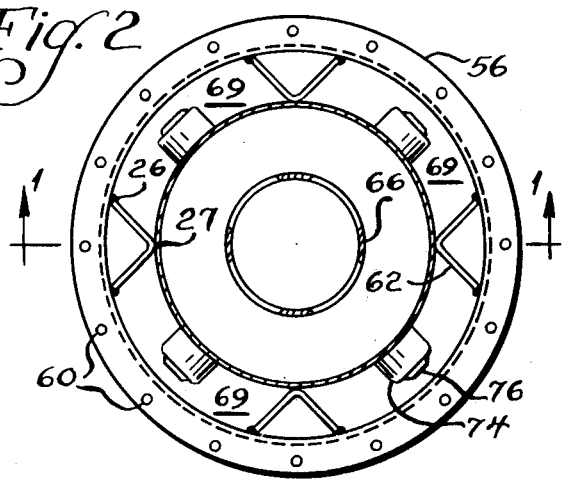
FIG. 2 is a top sectional view taken on the line 2—2 of FIG. 1.

As seen more clearly in FIG. 2, each module 28 preferably is provided with an access port 74 which may be selectively sealed by a fastener such as set screw member 76.

Figure 3:
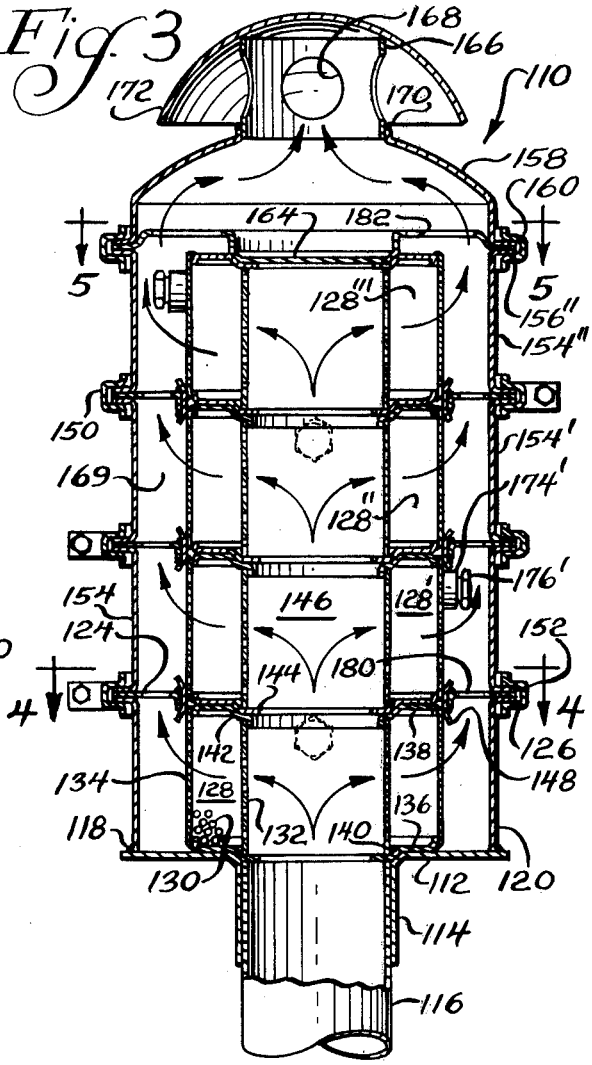
FIG. 3 is an axial cross-section of another embodiment of the invention taken on line 3—3 of FIG. 5.
Figure 5:
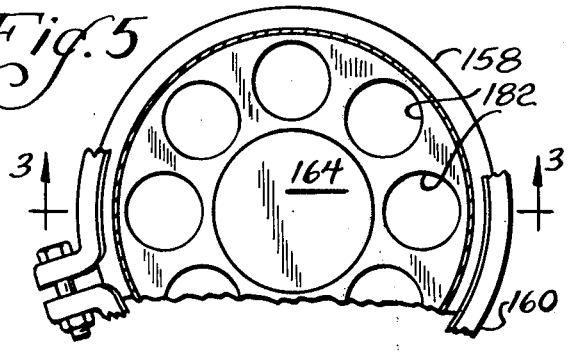
FIG. 5 is a top sectional view taken on the line 5—5 of FIG. 3.
Figure 4:
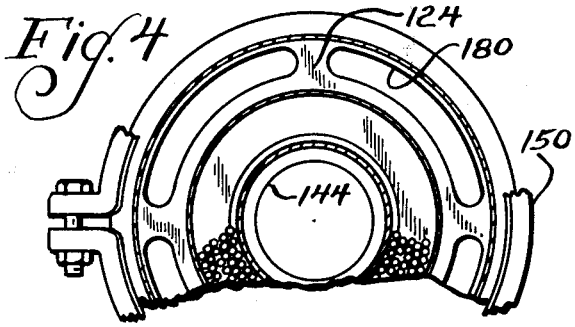
FIG. 4 is a top sectional view taken on the line 4—4 of FIG. 3.

The modification of the invention shown in the embodiment of FIGS. 3 through 5 is, in many respects, substantially identical to the embodiment of FIGS. 1 and 2. For example, elements 110–120, and 128–154 are substantially identical to the corresponding numbered elements 10–20 and 28–54 in FIG. 1. The spacer elements 124 in FIG. 3 comprise apertured bulkheads which have vertical centering portions 126 welded to them. The bulkheads 124 and centering portions 126 perform the same function as channels 24, 62 in FIG. 1 in that they guide and center the modules 128 inside the housing 110. The upper flange 156'' on the upper outer housing 154'' is clamped by a clamp ring 160 to the upper end housing portion 158 and an upper end closure member 164. An upper exhaust gas outlet tube 166 having apertures 168 is welded at 170 to the upper end housing 158. Covering the end of tube 166 is a weather cover 172 such as might be used if the unit were placed on the upper end of an exhaust pipe so that the gases could exit to the atmosphere. The module catalyst pellet access port 174' is shown as being sealed with a bolt 176'. The type of port or closure provided is of minor importance although it has been found that the design shown in FIG. 1 which utilizes a set screw (76) type of closure presents less interference with the exhaust gas flow in the outlet chamber 69. To permit upward flow of gases in chamber 169 along the inside of the housing walls 120, 154–154'', the bulkhead members 124 contain elongated slots 180 while the end closure member 164 contains apertures 182.

It will be appreciated that the modular concept disclosed herein will permit converters of varying capacity to be readily assembled to accommodate a large number of catalyst capacity requirements presented by a manufacturer's use of a number of different engine and drive train combinations. Since the incoming gases pass through only a relatively thin layer of catalyst in a large number of catalyst beds, it will be appreciated that back pressure losses will be significantly less than in prior art devices where the gas flow has to pass through serially arranged catalyst beds. As previously mentioned, the turbulator portions 44, 144 perform a significant function in preventing the gas flow up through the center of the converter from becoming laminar and thus insure that the incoming gases are evenly distributed to each module 28–28''', 128–128'''.

I claim as my invention:

1. A catalytic converter comprising a housing inlet and outlet tubes attached to said housing, and a plurality of identical, radial flow catalyst containing modules positioned axially within said housing, each of said modules having inner and outer perforated catalyst retaining screen portions and complementary, male and female, upstream and downstream end cap portions connecting said screen portions and serving to retain a stack of said modules in axial alignment when pressure is applied by said housing to the ends of the stack; spacer means carried by said housing for supporting said stack of modules against radial movement toward the side wall portions of the housing while permitting axial movement; turbulence inducing means extending radially from at least one of said screen portions on each of said modules into an axially extending inlet gas chamber which is closed at its downstream end while being defined along the major portion of its length by a screen portion on each of said modules; and releasable fastening means for holding at least two axially adjacent portions of said housing in sealed relationship with each other.

2. A catalytic converter in accordance with claim 1 wherein said housing includes a plurality of generally tubular body portions positioned radially outwardly of said stack of modules, each of said generally tubular body portions being releasably fastened to an axially adjacent body portion.

3. A catalytic converter in accordance with claim 2 wherein each of said body portions is releasably fastened to an axially adjacent body portion by a clamp ring which engages flange portions formed on said body portions.

4. A catalytic converter in accordance with claim 2 wherein a generally tubular body portion is provided for each of said modules.

5. A catalytic converter in accordance with claim 2 wherein at least one of said tubular body portions has an axial length corresponding to the combined axial length of a plurality of said modules.

6. A catalytic converter in accordance with claim 1 wherein said turbulence inducing means comprise an integral portion of one of said end cap portions.

7. A catalytic converter in accordance with claim 6 wherein said turbulence inducing means comprise an integral portion of said end cap portions which are at the upstream ends of said modules.

8. A catalytic converter in accordance with claim 7 wherein said inlet gas chamber is on the axis of said converter whereby gases entering said inlet gas chamber will pass radially outwardly through said catalyst containing modules.

9. A catalytic converter in accordance with claim 1 wherein each of said modules contains an access port having a selectively sealed aperture in its outer retaining screen portion.

10. A catalytic converter in accordance with claim 1 wherein said spacer means comprise a plurality of angled channel members each having leg portions in contact with the housing and a ridge portion adapted to guide the axial movement of a module into the housing during assembly and to retain it after assembly in a position spaced from the housing walls.

11. A catalytic converter in accordance with claim 2 wherein said spacer means comprise at least one bulkhead member extending radially inwardly from a juncture of axially adjacent body portions, said at least one bulkhead member being apertured to permit gases to flow axially through an exhaust gas outlet chamber defined by the inner wall portions of said body portions and said outer perforated screen portions.

* * * * *